US011059297B2

(12) United States Patent
Jeran et al.

(10) Patent No.: US 11,059,297 B2
(45) Date of Patent: Jul. 13, 2021

(54) INTEGRATED CIRCUIT DEVICE FOR A REPLACEABLE PRINTER COMPONENT

(71) Applicant: HEWLETT-PACKARD DEVELOPMENT COMPANY, L.P., Spring, TX (US)

(72) Inventors: Paul Jeran, Boise, ID (US); Bartley Mark Hirst, Boise, ID (US); Dee Chou, Boise, ID (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/604,890

(22) PCT Filed: May 21, 2017

(86) PCT No.: PCT/US2017/033711

§ 371 (c)(1),
(2) Date: Oct. 11, 2019

(87) PCT Pub. No.: WO2018/217185

PCT Pub. Date: Nov. 29, 2018

(65) Prior Publication Data

US 2020/0282735 A1 Sep. 10, 2020

(51) Int. Cl.
*B41J 2/175* (2006.01)

(52) U.S. Cl.
CPC ..... *B41J 2/17546* (2013.01); *B41J 2/1752* (2013.01); *B41J 2/1753* (2013.01); *B41J 2/17553* (2013.01)

(58) Field of Classification Search
CPC .. B41J 2/17546; B41J 2/1752; B41J 2/17553; B41J 2/1753
See application file for complete search history.

(56) References Cited

U.S. PATENT DOCUMENTS 5,491,540 A 2/1996 Hirst
6,239,879 B1 * 5/2001 Hay ..... B41J 29/393 347/214
6,375,298 B2 4/2002 Purcell et al.
(Continued)

FOREIGN PATENT DOCUMENTS

CN 1169268 7/1998
CN 1128720 C 11/2003
(Continued)

*Primary Examiner* — Sharon Polk
(74) *Attorney, Agent, or Firm* — Staas & Halsey, LLP

(57) ABSTRACT

In one example, an integrated circuit device for a replaceable printer component to communicate information about the component to a printer controller when a component with the integrated circuit device is installed in a printer. The integrated circuit device includes a controller, a memory operatively connected to the controller to store and/or generate information about the component, a single pair of conductors to supply power to the controller and to carry data signals to and from the controller, a detector to detect incoming data signals with a signal property associated with the component, and two electrical contacts each connected to one of the conductors to connect the integrated circuit device to a printer controller when a component with the integrated circuit device is installed in a printer.

15 Claims, 7 Drawing Sheets

(56) References Cited

U.S. PATENT DOCUMENTS

| | | | | |
|---|---|---|---|---|
| 6,459,363 | B1 | 10/2002 | Walker et al. | |
| 6,705,694 | B1 * | 3/2004 | Barbour | B41J 2/04506 347/19 |
| 7,154,911 | B2 | 12/2006 | Counterman | |
| 7,765,348 | B2 | 7/2010 | Dybsetter | |
| 8,554,958 | B1 * | 10/2013 | Weiser | B41J 2/17546 710/8 |
| 9,344,295 | B2 | 5/2016 | Sheffield et al. | |
| 9,630,417 | B2 * | 4/2017 | Campbell-Brown | B41J 2/17543 |
| 2004/0021711 | A1 * | 2/2004 | Hasseler | B41J 2/17546 347/7 |
| 2004/0136768 | A1 | 7/2004 | Klinefelter | |
| 2006/0082815 | A1 * | 4/2006 | Walker | B41J 2/17546 358/1.15 |
| 2011/0292102 | A1 * | 12/2011 | Asauchi | B41J 2/17546 347/5 |

FOREIGN PATENT DOCUMENTS

| | | |
|---|---|---|
| CN | 102112977 | 6/2011 |
| CN | 102285241 | 12/2011 |
| CN | 102367020 | 3/2012 |
| CN | 104066585 | 9/2014 |
| CN | 203832004 | 9/2014 |
| CN | 106335288 | 1/2017 |
| EP | 1029685 A2 | 8/2000 |
| EP | 2390098 | 11/2011 |
| WO | WO-03041378 | 5/2003 |
| WO | WO-03041367 | 5/2015 |
| WO | WO-2016171696 A1 | 10/2016 |

* cited by examiner

INTEGRATED CIRCUIT DEVICE FOR A REPLACEABLE PRINTER COMPONENT

CROSS REFERENCE TO RELATED APPLICATIONS

This application is filed under 35 U.S.C. § 371 as a PCT national phase of PCT International Application No. PCT/US2017/033711, filed on May 21, 2017, the contents of the International Application are incorporated by reference herein in their entirety.

BACKGROUND

In many printers toner, ink and other printing materials are contained in removable cartridges that may be replaced periodically, for example when the printing material is fully consumed. Printing material cartridges may include an integrated circuit device (IC) that enables the exchange of information between a cartridge and the printer controller when the cartridge is installed in a printer.

DRAWINGS

The same part numbers designate the same or similar parts throughout the figures.

DESCRIPTION

Figure 1:
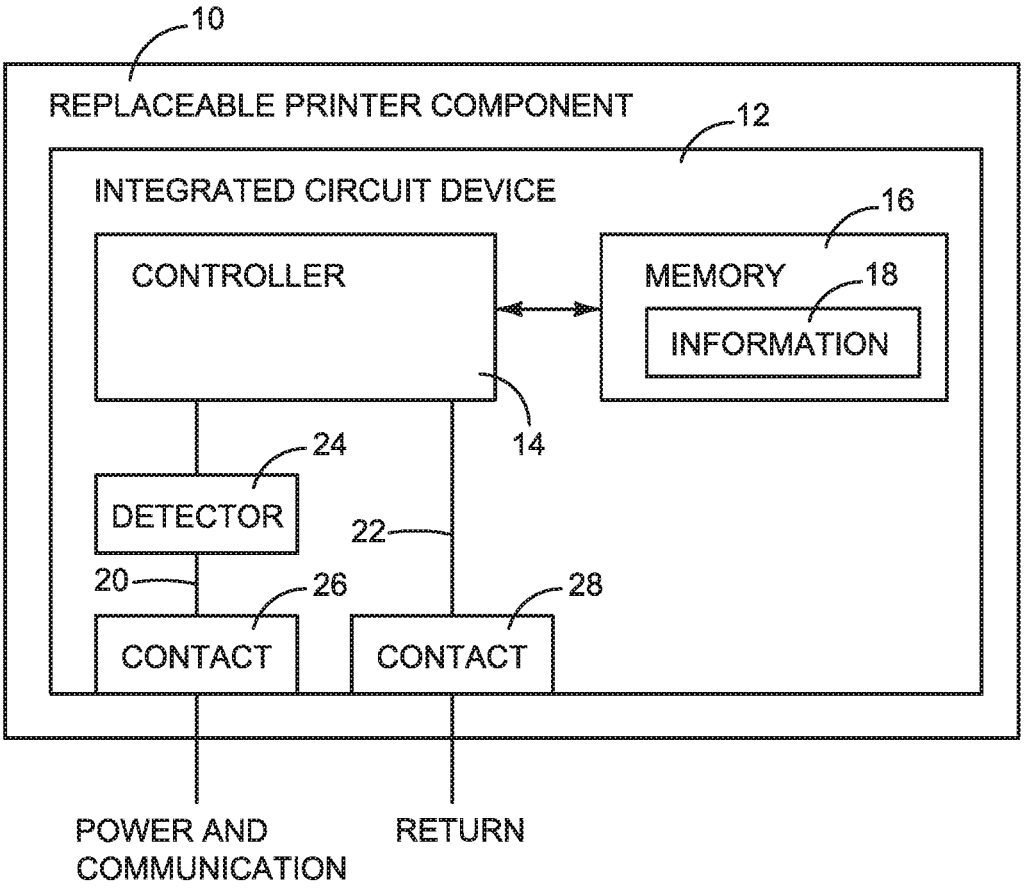
FIG. 1 is a block diagram illustrating a replaceable printer component implementing one example of a new integrated circuit device to communicate with a printer controller when the component is installed in a printer.

It is desirable for many printing applications to enable communication between a printer controller and the individual printing material cartridges in a group of cartridges. For example, a printer controller may wish to communicate individually with each of the cyan, magenta, yellow, and black toner cartridges in a color laser printer. A standard I20 bi-directional communication interface allows a printer controller to communicate individually with each of multiple individual cartridges over the same bus, but at the cost of a four conductor bus with four connectors on each cartridge IC.

A new technique has been developed that enables the use of a two conductor bus, and thus only two connectors on each cartridge IC, for bi-directional communication over the same bus between a printer controller and each of multiple individual cartridges with a single interface protocol. In one example, each IC in the group is configured to communicate with the printer controller along a two conductor bus according to an analog signal property different from an analog signal property of each of the other ICs in the group. In the case of frequency modulation, for example, each IC in the group includes a band pass filter to attenuate frequencies different from the frequency associated with the individual IC.

Examples are not limited to printing material cartridges. Examples may be implemented for other replaceable printing components including, for example, photoconductors, fusers and transfer belts in laser printers, build material supplies and fusing agent containers in 3D printers, and titration cassettes and biological or pharmaceutical material reservoirs in microfluidic digital dispensing devices. An IC for a replaceable printer component may include a controller, a memory operatively connected to the controller to generate and/or store information about the component, a single pair of conductors to supply power to the controller and to carry data signals to and from the controller, and a detector to detect incoming data signals with a signal property associated with the component. Two electrical contacts each connected to one of the conductors connect the component IC to a printer controller when a component with the IC is installed in a printer.

These and other examples described herein illustrate but do not limit the scope of the patent, which is defined in the Claims following this Description.

As used in this document, "and/or" means one or more of the connected things; a "printer" means any digital printing device or microfluidic dispensing system including, for example, laser printers, inkjet printers and other digital microfluidic dispensing devices, and 3D printers; and a "memory" means any non-transitory tangible medium that can embody, contain, store, or maintain information and instructions for use by a processor and may include, for example, circuits, integrated circuits, ASICs (application specific integrated circuits), hard drives, random access memory (RAM), read-only memory (ROM), and flash memory.

FIG. 1 is a block diagram illustrating a printing material cartridge or other replaceable printer component 10 implementing one example of a new integrated circuit device 12 to communicate with a printer controller when the component is installed in a printer. Referring to FIG. 1, integrated circuit device 12 includes a controller 14, a memory 16 connected to controller 14 to store and/or generate information 18 about component 10, and a single pair of conductors 20, 22 to supply power to controller 14 and the other elements of integrated circuit device 12 and to carry data signals to and from controller 14 (and to and from other elements of integrated circuit device 12 where data is not controlled exclusively by controller 14).

Integrated circuit device 12 also includes a detector 24 to detect incoming data signals with a signal property associated with component 10. A detector 24 is also commonly referred to as a "demodulator", particularly in the context of frequency modulation (FM) and amplitude modulation (AM). Electrical contacts 26, 28 are connected to conductors 20, 22, respectively, to connect integrated circuit device 12 to a printer controller through a two conductor bus when component 12 is installed in a printer. Although detector 24 is depicted as a discrete element in FIG. 1, separate from controller 14, detector 24 could be integral to controller 14, part of the same integrated circuit for example.

In one example, detector 24 is implemented with a programmable filter to attenuate incoming data signals with a signal property different from the signal property associated with component 10. In one example, the signal property used to address different components on the bus is frequency and detector 24 is implemented as a band pass filter programmed to pass frequencies within a band of frequencies associated with component 10 and to attenuate frequencies outside the band of frequencies associated with component 10. Detector 24 may include modulators and demodulators programmed with the desired modulation and demodulation methods and operating frequencies. A modulation frequency may be the same as or different from a demodulation frequency. A demodulation method for detector 24 may be the same as or different from a modulation method to modulate data returned to a printer controller, as determined by the printer controller.

A programmable filter associated with detector 24 may be programmable for bandwidth, center frequency of operation, and any gain or attenuation that may be desired for proper operation. The ability to program modulation and demodulation methods and operating frequencies may be particularly desirable in electrically noisy printing environments, for reconfiguring the communication system to help maintain optimal performance. For example, programming an angle modulation and demodulation method such as frequency modulation may improve the signal to noise ratio sufficiently to enable read/write operations during printing. Quadrature modulation of a frequency modulated data stream may be used to enable transmitting commands and data to component 10 simultaneously, for example by offsetting the phase by 90°, thus expanding the available bandwidth at the expense of just a slight increase in modulator and demodulator complexity.

Controller 14 represents generally the programming, processing and associated memory resources, and the other electronic circuitry and components to control data storage and retrieval to and from device 12, and any programming functions associated with device 12. Controller 14 may be implemented, for example, as a general purpose computer or a microcontroller configured to receive commands, data and requests for information from a printer controller and to act on those commands and requests to store data in memory 16, retrieve data from memory 16, and reconfigure detector 24 to the desired operating parameters. Although memory 16 is depicted as a discrete element in FIG. 1, separate from controller 14, memory 16 could be integral to controller 14, part of the same integrated circuit for example.

Figure 2:
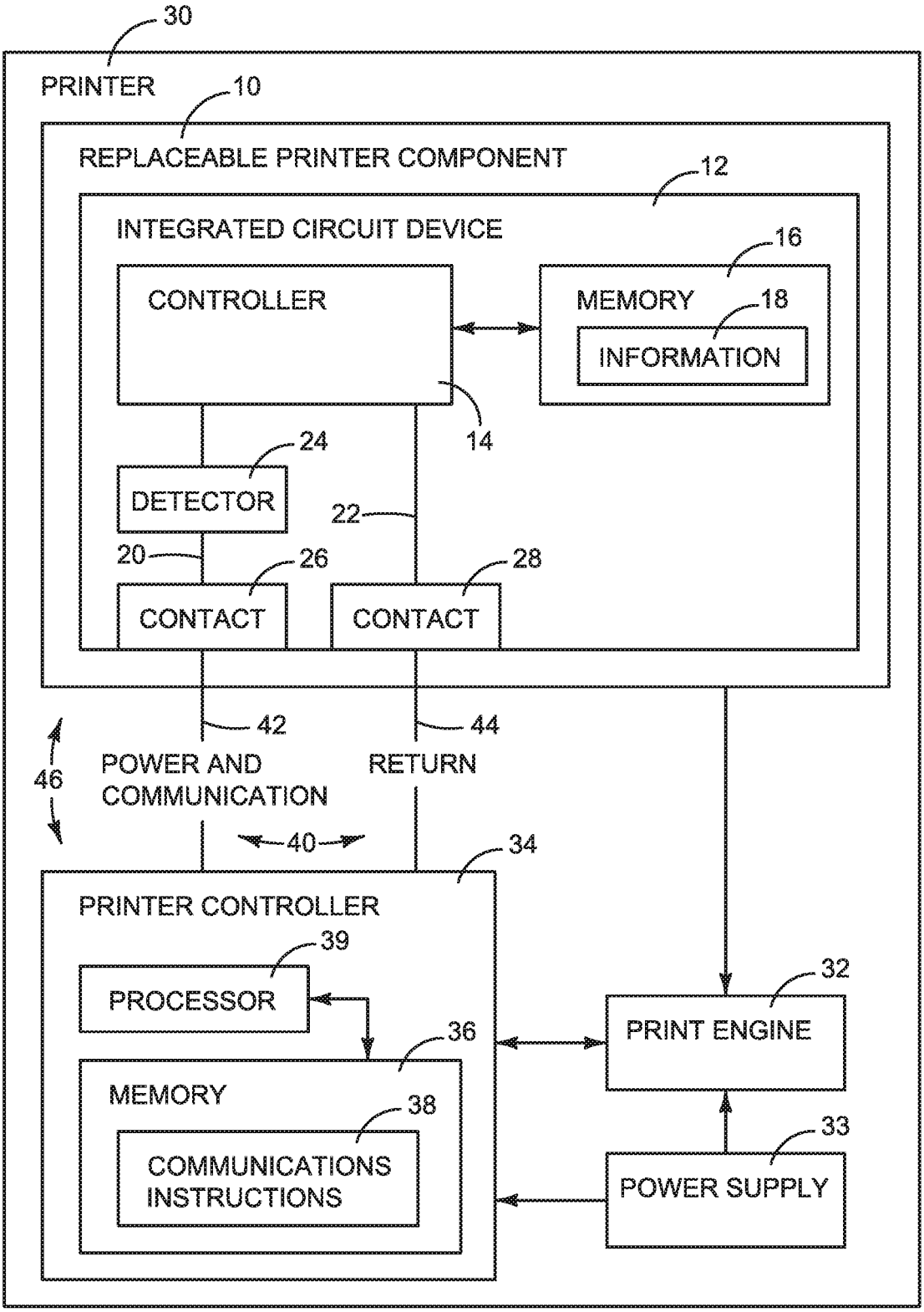
FIG. 2 is a block diagram illustrating a printer implementing one example of a new communications system for communications between the printer controller and a replaceable printer component.

FIG. 2 is a block diagram illustrating one example of a printer 30 implementing a communications system for communications between the printer controller and a replaceable printer component. Referring to FIG. 2, printer 30 includes replaceable printer component 10, a print engine 32, a power supply 33, and a controller 34 operatively connected to component 10, print engine 32, and power supply 33. In one example, component 10 is a printing material cartridge that supplies toner, ink or another printing material to print engine 32. While only one component 10 is shown, printer 30 may include multiple printing material cartridges and/or other replaceable components.

Print engine 32 represents the printer components that apply print material from a cartridge 10 to a paper or other print substrate. In a laser printer 30, for example, print engine 32 may include an imaging laser, a photoconductor, a fuser and a transport system to move the print substrate past the photoconductor and the fuser. In an inkjet printer, for another example, print engine 32 may include a printhead and a transport system to move the print substrate past the printhead. In other inkjet type microfluidic dispensing systems, print engine 32 may include a printhead array and a fixture to hold the workpiece under the array. In a 3D printer, print engine 32 may include a build material layering device, a fusing agent dispenser, and a fusing light. Some components of print engine 32 may be part of a replaceable cartridge 10. For example, in a laser printer 30, the photoconductor may be part of a replaceable toner cartridge 10. For another example, in an inkjet printer 30, the printhead may be part of a replaceable ink cartridge 10.

Printer controller 34 represents the programming, processing and associated memory resources, and the other electronic circuitry and components needed to control the operative elements of printer 30. In particular, controller 34 includes a memory 36 with communication instructions 38 and a processor 39 to execute instructions 38. Communications instructions 38 include instructions to communicate with the integrated circuit 12 on a printing material cartridge or other replaceable component 10 through a two conductor bus 40. Bus 40 includes a power and communications conductor 42 and a return conductor 44. Integrated circuit device controller 14, conductors 22, 24, detector 24 and contacts 26, 28 on integrated circuit 12, and bus 40 and printer controller 34 with communication instructions 38 on printer 30 together form an inter-component communications system 46.

Figure 3:
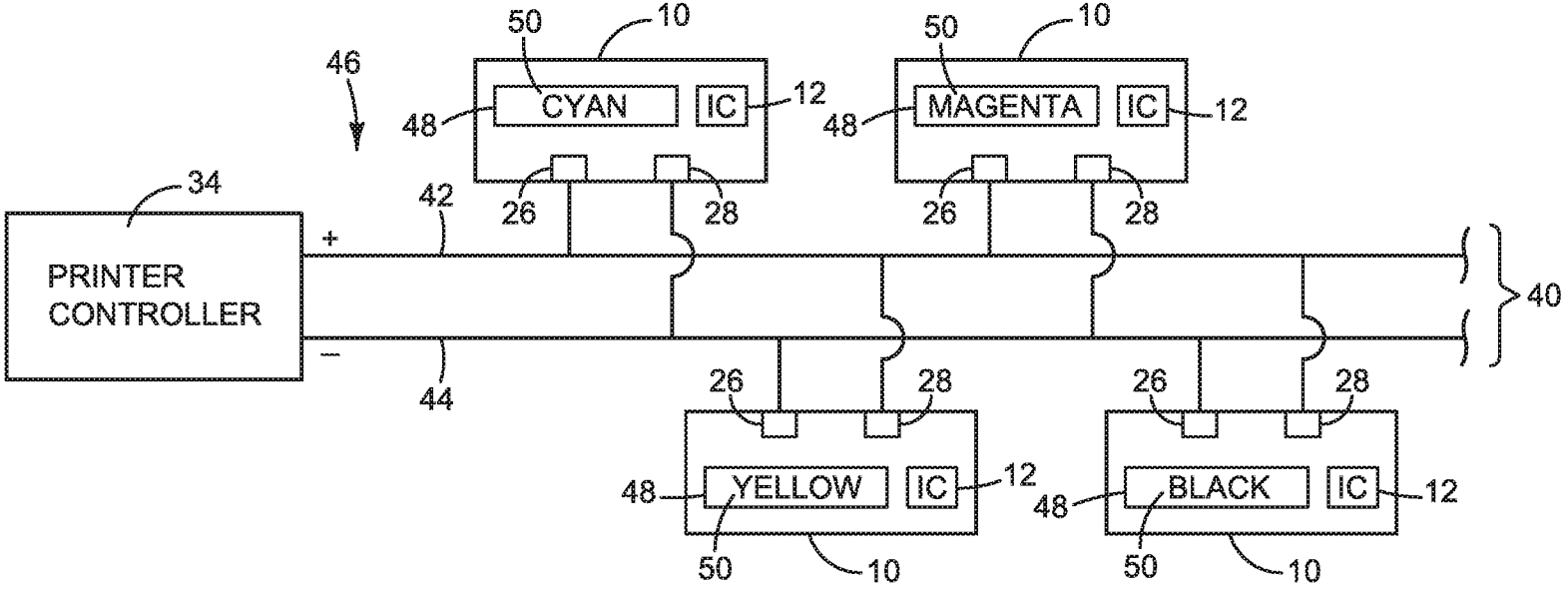
FIG. 3 is a block diagram illustrating one example of a communications system with multiple printing material cartridges connected to a printer controller along a two conductor bus.
Figure 4:
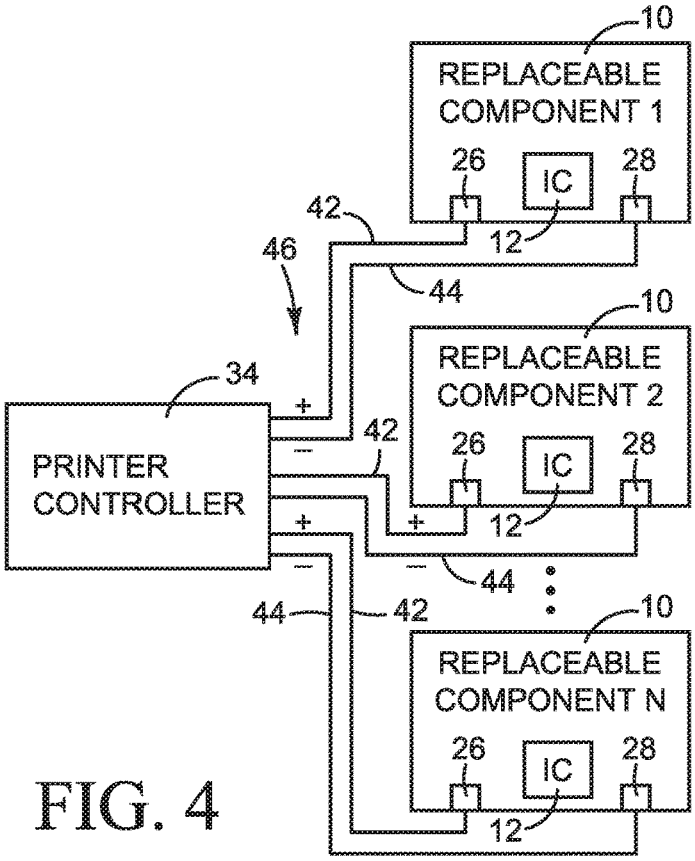
FIG. 4 is a block diagram illustrating one example of a communications system with multiple replaceable printer components each connected to a printer controller independently with a single pair of conductors.
Figure 5:
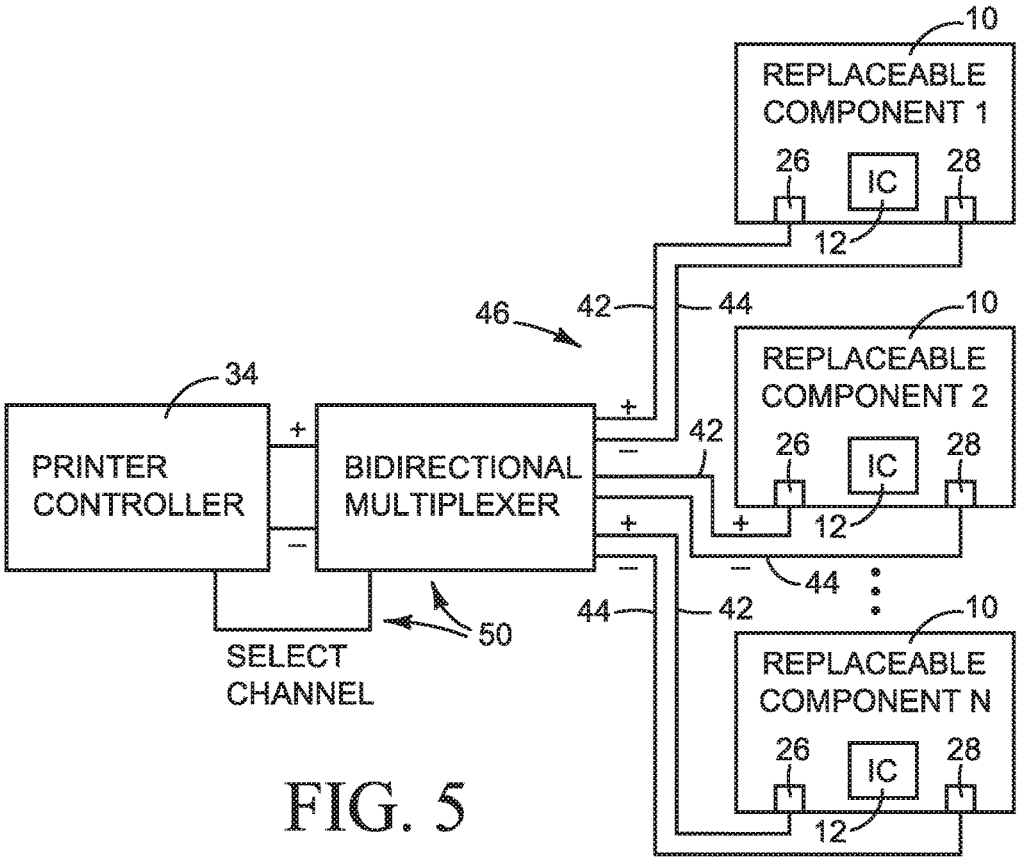
FIG. 5 is a block diagram illustrating one example of a communications system with multiple replaceable printer components each connected to a printer controller with a single pair of conductors through a bidirectional multiplexer.

FIG. 3 is a block diagram illustrating one example of a communications system 46 with multiple printing material cartridges 10 connected to a printer controller 34 through a two conductor bus 40. In this example, each cartridge 10 includes a container 48 with a different color printing material 50. In another example, shown in FIG. 4, multiple printing material cartridges and/or other replaceable printer components 10 with an integrated circuit device 12 are connected to printer controller 34 with a dedicated single pair of conductors 40, 42 for each component 10. In another example, shown in FIG. 5, a bidirectional multiplexer 52 is used to connect each component 10 to a printer controller 34 independently of the other components 10 in communications system 46.

Figure 6:
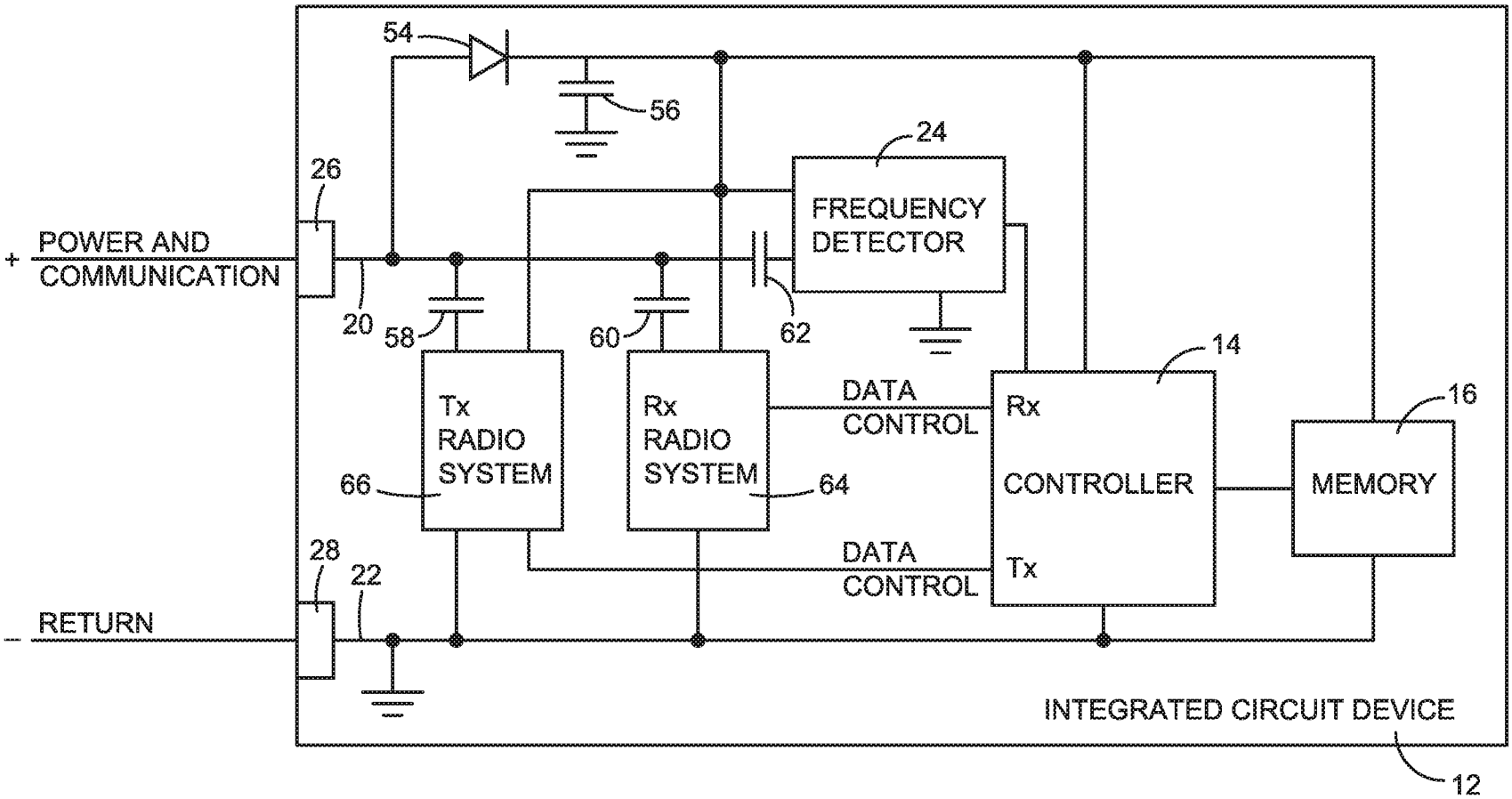
FIG. 6 illustrates one example of an integrated circuit device for a replaceable printer component in a group of components in which a printer controller may use frequency modulation to address the IC on each component individually.

FIG. 6 illustrates one example of an integrated circuit device 12 such as might be used for each cartridge 10 in FIG. 3, in which printer controller 34 uses frequency modulation to address each cartridge individually. Referring to FIG. 6, power and communication signals are supplied to conductor 20 at contact 26. Conductor 22 functions as a common point of reference through contact 28 to the print engine frame ground, for example, or any other suitable electrical frame of reference. In this example, power is directed to a rectifier 54 and a storage capacitor 56 to help stabilize the supply voltage to sensitive circuitry in controller 14 and memory 16, and to frequency extraction circuitry in a carrier signal frequency detector 24. Capacitors 58, 60, 62 may be used to AC couple data signals to detector 24, radio receiver system 64, and radio transmitter system 66.

In one example, data signals coupled to frequency detector 24 allow controller 14 to utilize a frequency chosen by the printer controller and associated with the integrated circuit device 12 on a replaceable component 10 (FIGS. 1-5)

as a local system clock. In another example, the local device controller 14 includes a lower accuracy oscillator or a higher accuracy MEMs clock circuit for the local system clock. Controller 14 uses this local system clock to set the desired frequency of operation for both the receiver radio system 64 and the transmitter radio system 66, thus allowing the use any frequency desired for receiving and sending data. Device controller 14 also interfaces with memory 16 to store and retrieve data for printing operations.

Data in each local memory 16 may be updated by the printer controller sending commands and data signals over bus 40 (FIG. 3) to receiver 64 and, after demodulation at detector 24, presented to controller 14 for storing to memory 16. When data in a component IC memory 16 is desired by the printer controller, a separate command is sent over bus 40 (FIG. 3) to receiver 64 and then to controller 14. Controller 14 obtains the desired data from memory 16, turns on transmitter 66, programs the desired transmit frequency and modulation method and then transmits the data to the printer controller.

Figure 7:
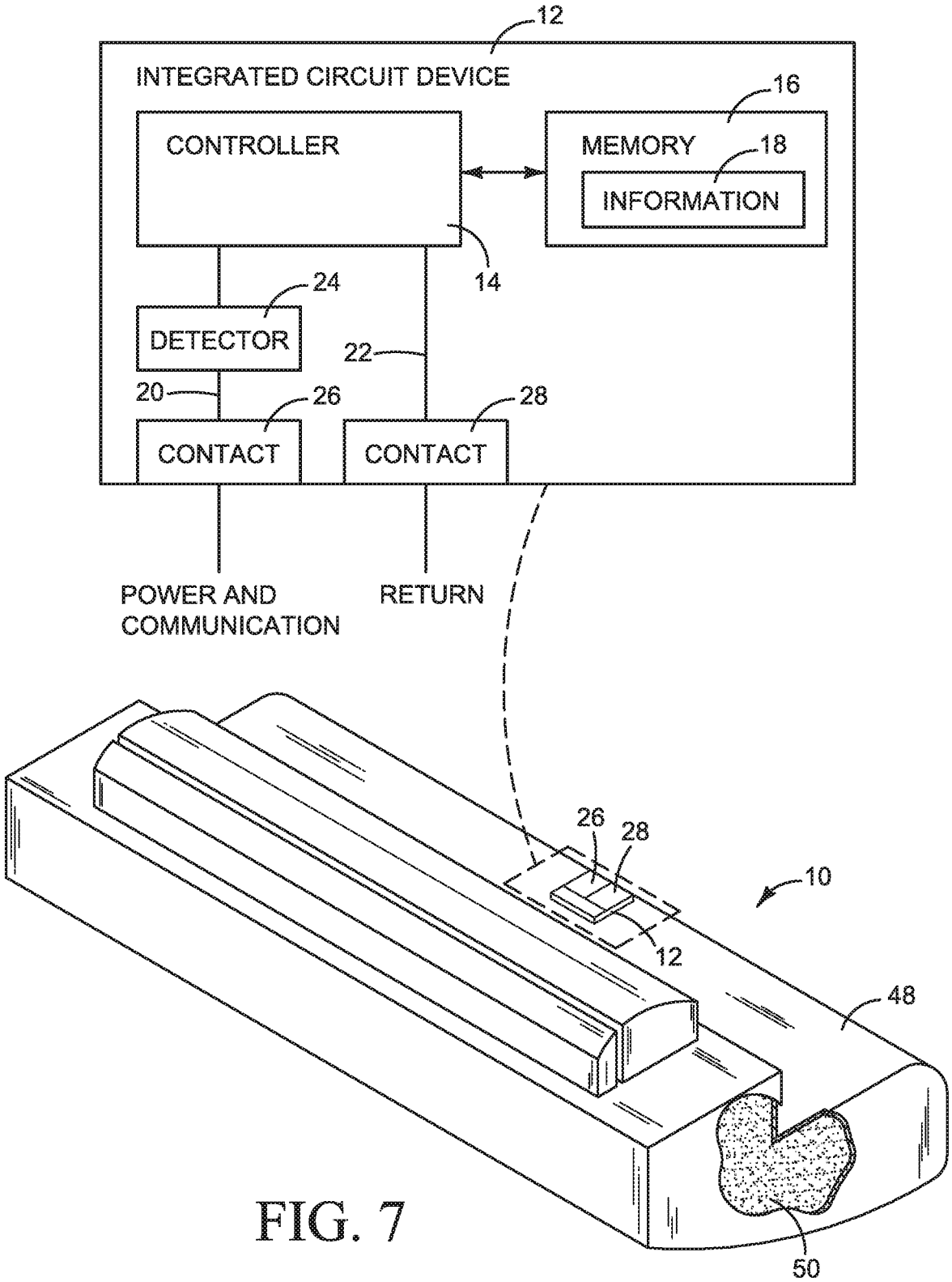
FIG. 7 illustrates one example of a toner cartridge implementing an integrated circuit device such as the one shown in FIG. 1.
Figure 8:
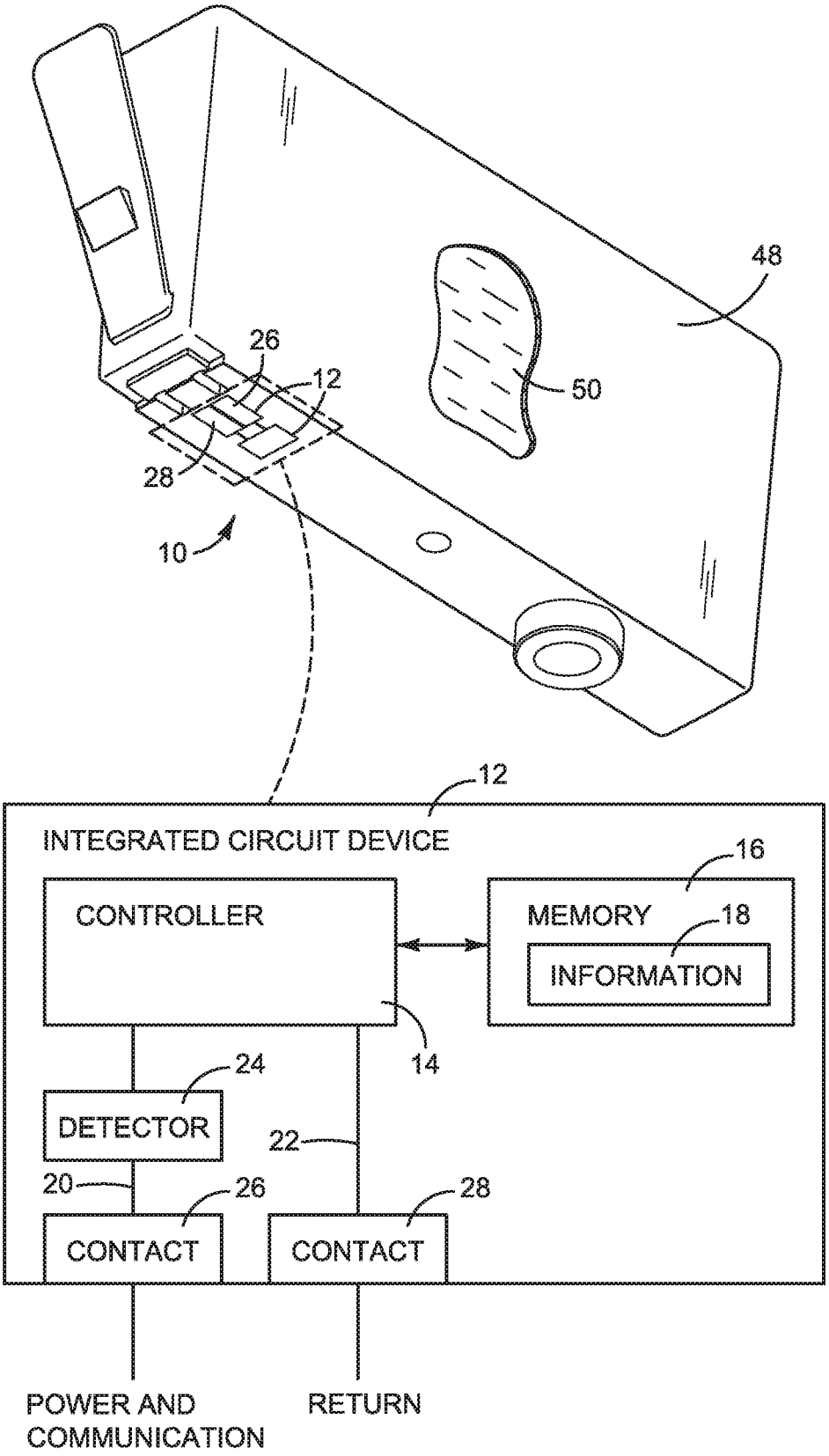
FIG. 8 illustrates one example of an ink cartridge implementing an integrated circuit device such as the one shown in FIG. 1.

In one example, replaceable component 10 is implemented as a toner cartridge 10 shown in FIG. 7. In another example, component 10 is implemented as an ink cartridge 10 shown in FIG. 8. Information 18 residing in memory 16 for a printing material cartridge 10 may include, for example, information about the toner or ink in the cartridge, information to authenticate the cartridge to a printer controller, and/or information to identify the cartridge to a printer controller. Also, while a cartridge 10 will usually contain printing material when installed in a printer, a printing material cartridge 10 in FIGS. 3, 7 and 8 represents a printing material cartridge with or without printing material 50 including, for example, an empty cartridge before it is filled (or refilled) with printing material.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means one or more.

The invention claimed is:

1. An article for a replaceable printer component, comprising:

an integrated circuit device to communicate information about the replaceable printer component to a printer controller of a printer when a component with the integrated circuit device is installed in the printer, the integrated circuit device including:

a controller;

a memory operatively connected to the controller to store and/or generate information about the component;

a single pair of conductors to supply power from a bus to the controller and to carry data signals between the bus and the controller;

a detector to detect incoming, over the bus, data signals of the printer controller with a signal modulation property associated with the component; and two electrical contacts each connected to one conductor of the single pair of conductors to connect the integrated circuit device to a printer controller when a component with the integrated circuit device is installed in a printer.

2. The article of claim 1, where the detector is configurable in response to a command from the controller to change the signal modulation property associated with the component.

3. The article of claim 1, where the detector comprises a filter to attenuate incoming data signals having a signal modulation property different from a signal modulation property associated with the component.

4. The article of claim 1, where the signal modulation property associated with the component is a signal frequency, a signal amplitude, and/or a signal phase.

5. The article of claim 1, where the integrated circuit device includes a transmitter to transmit data signals over the conductors having the signal modulation property associated with the component.

6. The article of claim 1, where the component is a printing material cartridge and the memory is operatively connected to the controller to generate and/or store information about printing material in the cartridge, information to authenticate the cartridge to a printer controller, and/or information to identify the cartridge to a printer controller.

7. The article of claim 5, where the component is a cartridge, and the memory stores information about printing material in the cartridge, information to authenticate the cartridge to a printer controller, and/or information to identify the cartridge to a printer controller.

8. The article of claim 6, where the cartridge is a toner cartridge or an ink cartridge.

9. A group of integrated circuit devices each for a different printing material cartridge in a group of related printing material cartridges, each device in the group storing information about a corresponding cartridge and each device in the group configured to communicate with a printer controller along a two conductor bus according to data signals with a signal modulation property received from the printer different from a signal modulation property of each of the other devices in the group.

10. The group of claim 9, where each integrated circuit device in the group is configured to communicate with a printer controller along the two conductor bus according to a single interface protocol.

11. The group of claim 9 where each integrated circuit device in the group is configurable to change the signal modulation property.

12. The group of claim 9, where each integrated circuit device includes:

a controller;

a memory operatively connected to the controller, the memory storing the information about the corresponding cartridge;

a single pair of conductors to simultaneously supply power from the bus to the controller and to carry data signals between the bus and the controller when a cartridge with the integrated circuit device is installed in a printer; and a signal filter to attenuate incoming data signals having a signal modulation property different from a signal modulation property associated with the integrated circuit device; and two electrical contacts each connected to one of the conductors to connect the integrated circuit device to the bus when a cartridge with the integrated circuit device is installed in a printer.

13. A group of integrated circuit devices each for a corresponding different color printing material cartridge, each device in the group including:

a memory storing information about the corresponding cartridge;

a single pair of conductors to supply power to the memory controller and to carry data signals to and from the memory according to an analog signal property different from an analog signal property of each of the other devices in the group; and two electrical contacts each connected to one of the conductors to connect an integrated device of the group of integrated circuit devices to a two conductor bus when a cartridge with the integrated circuit device is installed in a printer.

14. The group of claim 13, where each integrated circuit device in the group is configurable by a printer controller to change the analog signal property.

15. The group of claim 14, where each integrated circuit device includes a filter to attenuate incoming data signals having a signal property different from a signal property associated with the integrated circuit device, the filter configurable in response to a command from a printer controller to change the signal property associated with the integrated circuit device.

* * * * *